US012004668B2

(12) United States Patent
Maccarone

(10) Patent No.: US 12,004,668 B2
(45) Date of Patent: Jun. 11, 2024

(54) GARMENT DISPLAY DEVICE

(71) Applicant: Jersey Racks LLC, Gibbstown, NJ (US)

(72) Inventor: Samuel Maccarone, Gibbstown, NJ (US)

(73) Assignee: Jersey Racks LLC, Gibbstown, NJ (US)

( * ) Notice: Subject to any disclaimer, the term of this patent is extended or adjusted under 35 U.S.C. 154(b) by 33 days.

(21) Appl. No.: 17/369,071

(22) Filed: Jul. 7, 2021

(65) Prior Publication Data

US 2022/0007870 A1 Jan. 13, 2022

Related U.S. Application Data

(60) Provisional application No. 63/050,219, filed on Jul. 10, 2020.

(51) Int. Cl.
*A47G 25/44* (2006.01)
*A47F 7/22* (2006.01)

(52) U.S. Cl.
CPC ..... *A47G 25/442* (2013.01); *A47F 7/22* (2013.01); *A47G 25/447* (2013.01)

(58) Field of Classification Search
CPC ..... A41H 5/00; A41H 5/01; A47B 61/003; A47F 7/22; A47F 7/26; A47F 8/00; A47F 8/02; A47G 25/441; A47G 25/442; A47G 25/443; A47G 25/0607; A47G 25/0685; F16M 13/027; F16M 13/022
See application file for complete search history.

(56) References Cited

U.S. PATENT DOCUMENTS 1,188,921 A * 6/1916 Finkelstein ..... A47G 25/0671 211/1
1,833,503 A * 11/1931 Albertia ..... A47F 8/02 223/68
2,157,822 A * 5/1939 Holder ..... D06F 59/02 223/69
2,188,986 A * 2/1940 Schwartz ..... D06F 59/02 223/69
2,233,492 A * 3/1941 Sperry ..... A47G 25/20 223/69
2,410,230 A * 10/1946 Parker, Jr. ..... D06F 59/02 223/69
2,657,842 A * 11/1953 Smith ..... A47F 8/02 223/68
2,707,070 A * 4/1955 Tanzer ..... A47F 8/02 223/94
2,803,386 A * 8/1957 Feja ..... D06F 59/02 D6/318
3,008,613 A * 11/1961 Paris ..... D06C 5/005 223/69
3,294,295 A * 12/1966 Wolf ..... A41H 5/00 D20/32
3,480,187 A * 11/1969 Bonn ..... D06F 71/16 223/67
3,645,425 A * 2/1972 Witzke ..... A47G 25/442 223/69
4,311,260 A * 1/1982 Toy ..... A47F 8/00 223/63

(Continued)

*Primary Examiner* — F Griffin Hall
(74) *Attorney, Agent, or Firm* — Fox Rothschild LLP

(57) ABSTRACT

A device for hanging and displaying garments in an aesthetically pleasing manner, and methods of using the device.

17 Claims, 5 Drawing Sheets

(56) References Cited

U.S. PATENT DOCUMENTS

| | | | | | |
|---|---|---|---|---|---|
| 4,333,575 | A * | 6/1982 | Wong | A47G 25/0685 | 211/100 |
| 4,545,514 | A * | 10/1985 | Toy | A47F 8/02 | 223/66 |
| 4,739,911 | A * | 4/1988 | Quinn | A47F 8/02 | 223/66 |
| D309,834 | S * | 8/1990 | Passini | D6/318 | |
| 6,601,326 | B1 * | 8/2003 | Bublitz | G09F 19/08 | 40/418 |
| 8,146,784 | B1 * | 4/2012 | Calanca | A47G 25/4061 | 211/85.3 |

* cited by examiner

GARMENT DISPLAY DEVICE

CROSS-REFERENCE TO RELATED APPLICATION

The present application claims priority to U.S. Provisional Patent Application No. 63/050,219, filed Jul. 10, 2020, entitled GARMENT DISPLAY DEVICE, which is incorporated herein by reference in its entirety.

FIELD

The present disclosure relates to a device for displaying garments, and methods of using the same.

BACKGROUND

Sports fans enjoy wearing and displaying clothing bearing the name or log of their favorite sports teams. However, oftentimes, fans have to make a choice between displaying or wearing their sports garment. A common way to display fan garments, including collectible garments, is to seal the garment within a display case, commonly known as a shadow box, jersey case, jersey display or shirt case, which can be hung on a wall or otherwise displayed for viewing. The sports garment is secured within the case, under a panel of glass, through which the garment can be observed. However, this is often not desirable because once the garment is encased behind the glass, it can no longer be worn. Further, this type of display does not present the garment in an authentic or life-like manner. While a life-like display could be achievable by instead placing the garment on a mannequin, this, undesirably, would take up floor space. Also, conventional display cases only convey limited information, namely either the front or the back of the jersey that is viewable to an observer.

Those choosing not to frame their sports garments tend to leave them hanging in their closets, which does not afford the opportunity for the garment owner, and others, to openly admire the garment. Even if one were to use a conventional hanger to hang the garment outside of the closet, the hanger would not be able to display a variety of garments having different sleeve lengths, in a visually pleasing way.

Additionally, sports fans enjoy collecting a variety of sports paraphernalia, such as trophies, books, figurines, hats, tools, and the like. Oftentimes, one will find such collectibles located at various locations, separate from the sports jersey. It would be desirable for these fans to be able to assemble and display their collectibles in one location. It would be even more desirable if they could neatly display their collectible objects alongside a display of their favorite sports garment.

There is a need for an apparatus that addresses at least one of the above disadvantages. More particularly, there is a need for an apparatus that enables a user to neatly hang their sports garment, while having the ability to easily remove and wear the garment when desired, and to easily rehang it for display after wearing it. Additionally, there is a need for such an apparatus that can be adjusted to provide an aesthetically pleasing display of garments having different sleeve lengths. Further, there is a need for such a device that also provides the ability to display other types of sports memorabilia.

SUMMARY

This patent document discloses a device for hanging and displaying garments in an aesthetically pleasing manner, and methods of using the same.

A first aspect of the disclosure provides a garment display device including (1) an attachment base including a pair of support arms including a left support arm, and a right support arm; (2) a right primary arm plate rotatably attached to the right support arm; and (3) a left primary arm plate rotatably attached to the left support arm, wherein the right and left primary arm plates are rotatable within a single plane; wherein the right and left primary arm plates each include a plate support member including an upper surface, a lower surface and side surfaces; and wherein each primary arm plate is connectable to a secondary arm plate. In some embodiments, the right and left primary arm plates each further include an extender member extendably connected to one of the upper or the lower surface of the support member. In some embodiments, the left and right support arms are each substantially Z-shaped.

In some embodiments, the attachment base further includes an anchor panel. In some embodiments, the left support arm, right support arm, and anchor panel form a single, uninterrupted unit. In some embodiments, the attachment base is attached to a shelving unit. In some embodiments, more than one attachment bases are attached to the shelving unit. In some embodiments, at least one of the attachment bases is attached to a lengthening panel that is attached to the shelving unit. In some embodiments, the extender member is extendable by sliding the extender member. In some embodiments, each primary arm plate support member has a recess within one of the lower or upper surface. In some embodiments, each extender member includes a top surface, a bottom surface, and at least two cutouts extending from the top to the bottom surface of the extender member, and the plate support member further includes at least one protrusion extending from the upper or lower surface of the plate support member. In some embodiments, the extender member is slidable within the recess. In some embodiments, a plurality of cutouts extend from the top to the bottom surface of each extender member.

In some embodiments, the garment display device further includes at least one secondary right arm plate, and at least one secondary left arm plate, wherein at least one of the secondary right arm plates is rotatably and detachably attached to the primary right arm plate, and at least one of the secondary left arm plates is rotatably and detachably attached to the primary left arm plate, and wherein the secondary right and left arm plates each include a secondary right and left arm plate support member, respectively, including an upper surface, a lower surface and side surfaces, and a secondary plate extender member extendably connected to one of the lower or upper surface of the secondary plate support member. In some embodiments, the garment display device includes at least one additional secondary right arm plate, and at least one additional secondary left arm plate, wherein each additional secondary right arm plates is rotatably and detachably attached to at least one other secondary right arm plate, and each additional secondary left arm plates is rotatably and detachably attached to at least one other secondary left arm plate.

In some embodiments, the device further includes a plurality of secondary right arm plates rotatably and detachably attached to one another, and a plurality of lower left arm plates rotatably and detachably attached to one another. In some embodiments, (1) at least one of the primary plate support members is attached to the plate extender member of a secondary arm plate; or (2) at least one of the primary plate extender members is attached to the plate support member of a secondary arm plate. In some embodiments, each secondary plate support member is attached to the plate extender member of a different secondary arm plate.

A second aspect of the disclosure provides a method of hanging a garment on the garment display device according to the first aspect, including the steps of: (1) orienting the left and right primary arm plates in a substantially vertical, downward position; (2) inserting the pair of primary arm plates into the neck of a garment; (3) raising the left primary arm plate upwards, toward a left shoulder portion of a garment; and (4) raising the right primary arm plate upwards, toward a right shoulder portion of the garment.

A third aspect of the disclosure provides a method of hanging a garment on the garment display device according to the first aspect, including the steps of: (1) orienting the left and right primary arm plates in a substantially vertical, downward position; (2) orienting the left and right secondary arm plates in a vertical, downward position; (3) inserting the pairs of primary and secondary arm plates into the neck of a garment; (4) raising the left primary arm plate and the secondary arm plate upwards, toward a left shoulder portion of a garment; and (5) raising the right primary arm plate and the right secondary arm plate upwards, toward a right shoulder portion of the garment.

In some embodiments of the methods of the second and third aspects, the method further includes the step of adjusting the extender members of at least one of the pairs of primary or secondary arm plates, thereby lengthening or shortening the arm plates.

BRIEF DESCRIPTION OF THE DRAWINGS

FIG. 3(*a*) is an angled rear view of a garment display device where cutouts in the extender members can be repositioned on protrusions extending from the recess in the plate support members; FIG. 3(*b*) is an angled rear view of a garment display device having extender members that slide within the recess in the plate support members; FIG. 3(*c*) is the front view of a garment display device having extender members that slide within the recess in the plate support members.

DETAILED BRIEF DESCRIPTION OF THE INVENTION

This invention relates to a garment display device that provides for the display of different styles of upper body garments, such as sport jerseys, or other types of shirt, in an aesthetically pleasing way.

Figure 1:
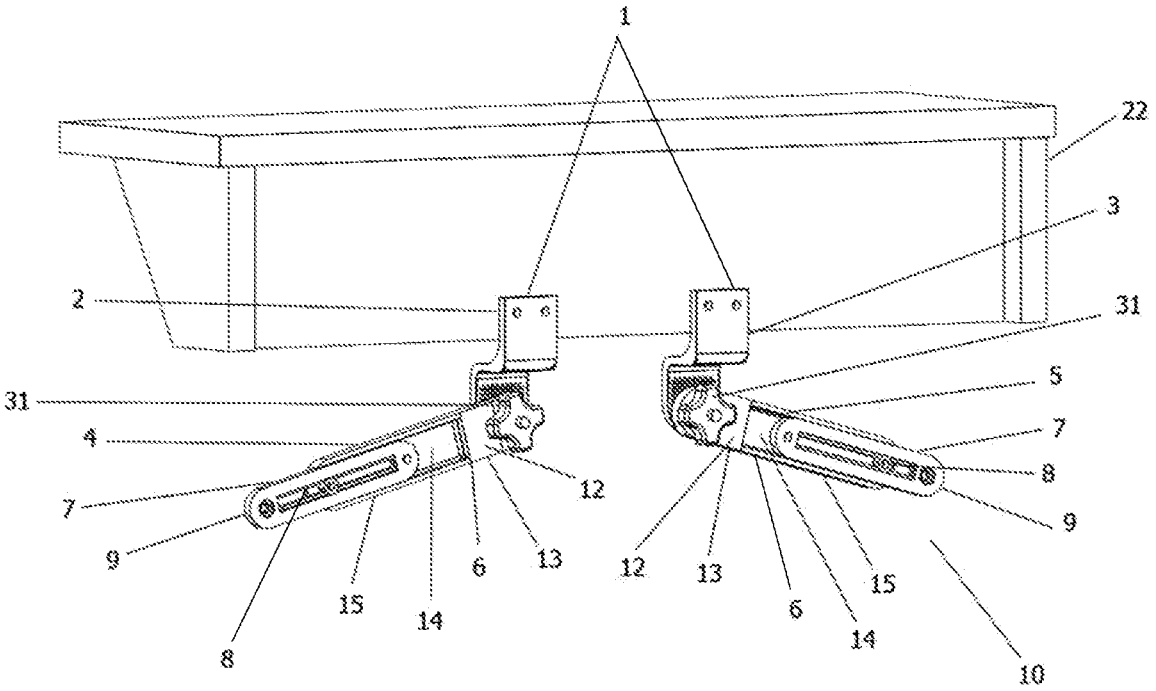
FIG. 1 is an angled rear view of a garment display device, with the device's support arms attached to the rear of a shelving unit.

As shown in FIG. 1, the garment display device 10 has an attachment base 1. The attachment base 1 includes a left support arm 2 and a right support arm 3. The shape of the support arms 2 and 3 may vary, depending on the desired design of the garment display device. Each support arm 2 and 3 is attached to a respective primary arm plate 4 and 5, so that the left support arm 2, is connected to the left primary arm plate 4, and the right support arm 3, is connected to the right primary arm plate 5. Each primary arm plate 4 and 5 is rotatably connected to its respective support arm 2 or 3, in such a way that the attachment enables the primary arm plate 4 or 5 to rotate. The primary arm plates 4 and 5 each rotate within a single plane. In some embodiments, primary arm plate 4 and 5 rotation range within that plane is at least 180 degrees. In some embodiments, their rotation range is at least 90 degrees. The primary arm plates 4 and 5 may be attached to the support arms 2 and 3 by any suitable means. For example, in some embodiments, they may be attached by a screw (not shown) and lock nut 31 that screws onto the screw (not shown), and that can be adjusted, as necessary, by the user. Each primary arm plate 4 and 5 is made of a plate support member 6 and, in some embodiments, also an extender member 7 that is extendably connected to the plate support member 6. In some embodiments, for example where a sleeveless or short sleeved garment is to be hung from the garment display device 10, the device 10 may be used without the extender member 7. Each primary arm plate 4 and 5 is designed such that the primary arm plate 4 or 5 can be extended, in the plane of the length of the primary arm plate 4 or 5.

The extension of each primary arm plate 4 and 5 is achieved by adjusting the extender member 7, so that the extender member 7 extends to a desired distance past a distal end 8 of the plate support member 6. Each primary arm plate 4 or 5 can also be retracted to a desired length, by adjusting the extender member 7 back towards the opposing distal end 8 of the plate support member 6. Where no extension is desired, the extender member 7 may be adjusted so that a distal end 9 of the extender member 7 does not extend past a distal end 8 of the plate support member 6. The left and right primary arm plates 4 and 5 are capable of being connected to additional arm plates.

Figure 2:
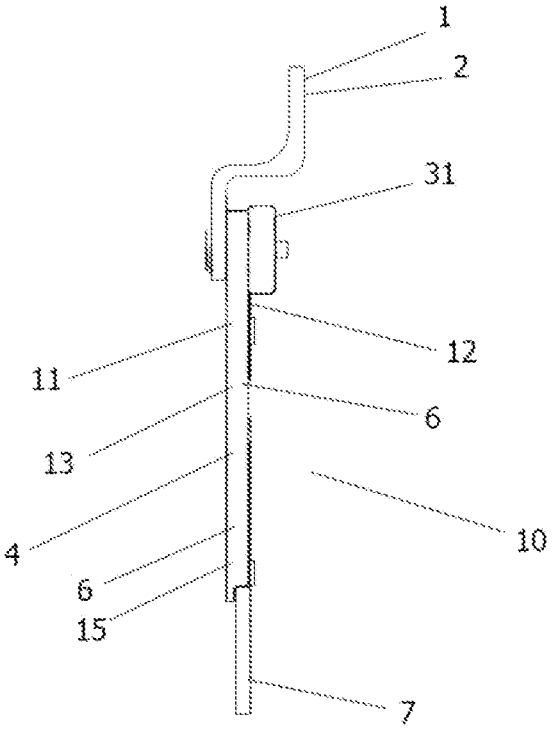
FIG. 2 is a side view of a garment display device.
Figure 3A:
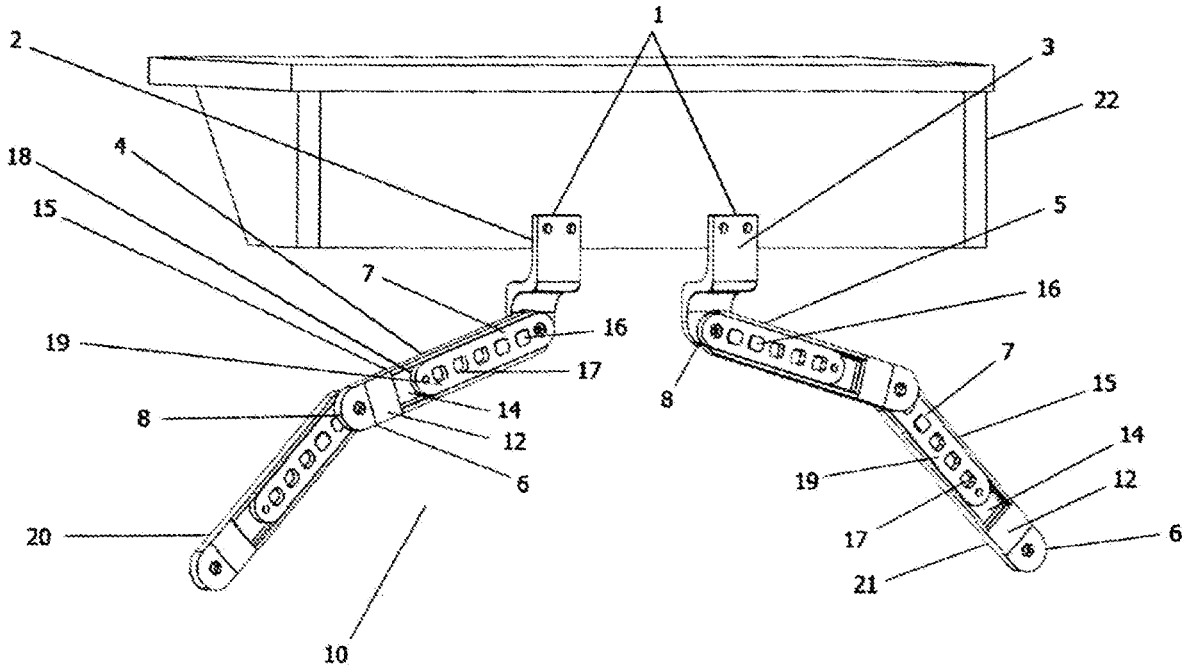
FIG. 3(*a*), FIG. 3(*b*), and FIG. 3(*c*) is a garment display device having primary and secondary arm plates.
Figure 3B:
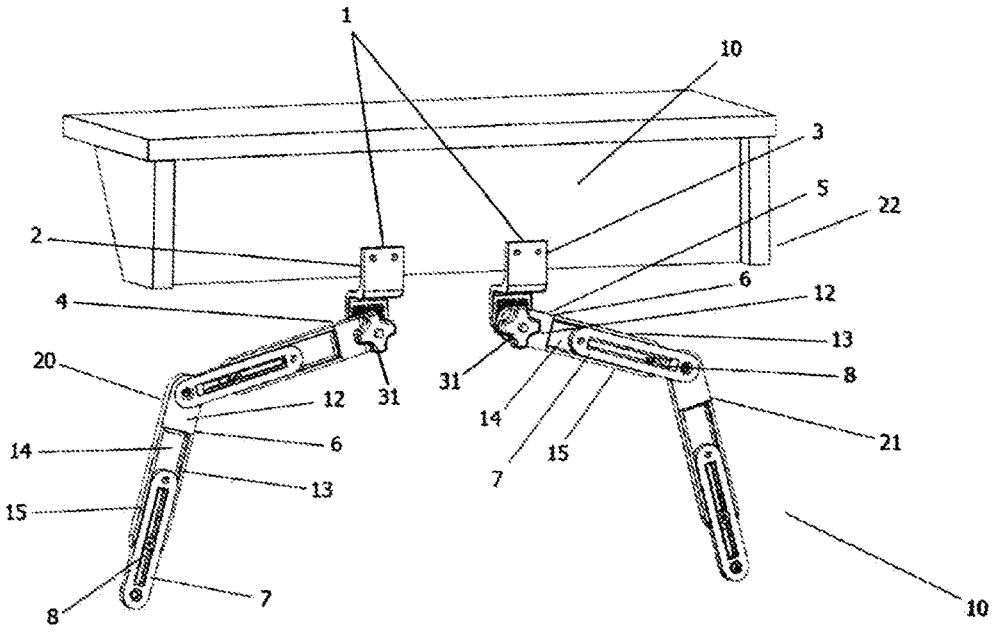
Figure 3C:
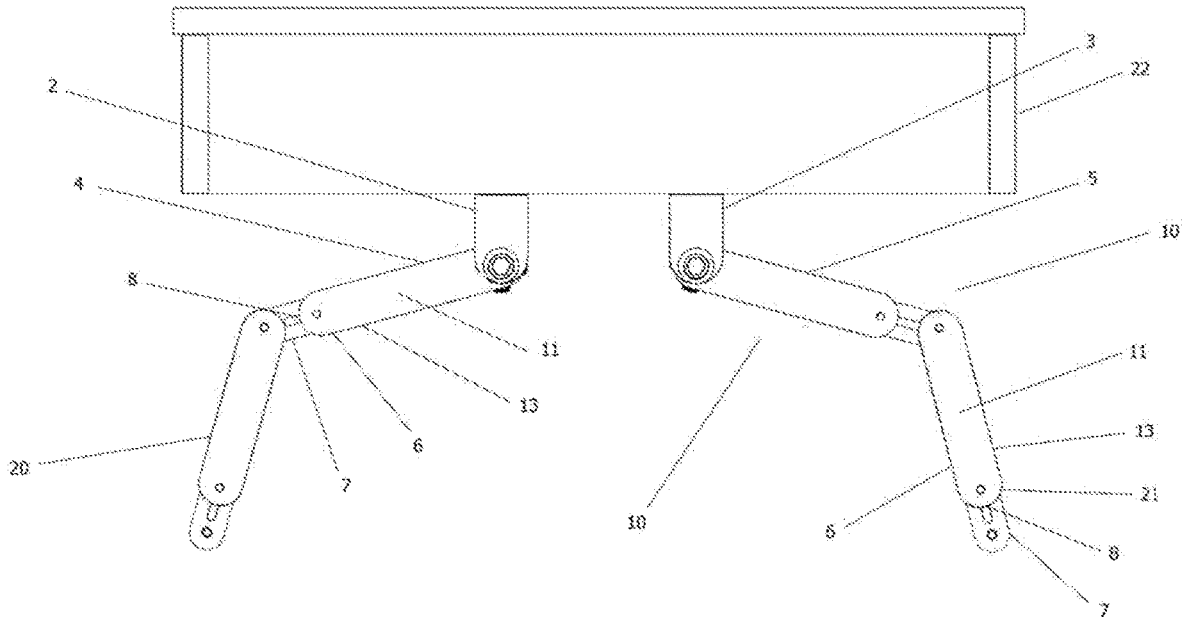

The plate support member 6 and extender member 7 of each primary arm plate 4 and 5 may be arranged in any suitable manner that allows for the extension of the primary arm plates 4 and 5. In some embodiments, the extender member 7, is extended by sliding the extender member within the plate support member 6. For example, as shown in FIG. 1, FIG. 2, FIG. 3(*a*), FIG. 3(*b*) and FIG. 3(*c*), in some embodiments, the plate support member 6 has an upper surface 11, a lower surface 12 and side surfaces 13. Either the upper surface 11 or lower surface 12 of the plate support member 6 has a recess 14 extending at least partially along the length of the plate support member 6, with at least one end of the recess open at a distal end 8 of the plate support member 6. In some embodiments, the recess 14 extends substantially along the length of the plate support member 6. In some embodiments, the recess 14 extends along at least two-thirds of the length of the plate support member 6. Bordering the length of the recess 14 is a retaining wall 15, whose outer surface is the side surface 13 of the plate support member 6. The extender member 7 fits within the recess 14, with the extender member's 7 length bordered by the retaining wall 15, where it can be slid back and forth, along the plane of the primary arm plate 4 or 5.

In some embodiments, the primary arm plate 4 or 5, is extended by attaching the extender member 7 at the desired position along the recess 14 in the plate support member 6. For example, as shown in FIG. 3(*a*), in some embodiments, there is at least one protrusion 16, extending from the recess 14 in the plate support member 6. There are a plurality of cutouts 17 in the extender member 7, extending throughout the depth of the extender member 7, from the top surface 18 to the bottom surface 19 of the extender member 7. Each cutout 17 has a shape and size that enables the cutout 17 to be securely inserted onto a protrusion 16. The primary arm plate 4 or 5 can be or lengthened or shortened by attaching at least one of the protrusions 16 in at least one of the cutouts 17, thereby enabling the user to select their desired the length.

As noted above, the left and right primary arm plates 4 and 5 are capable of being connected to additional arm plates. This extendable design of the garment display device 10 enables a user to adjust the length of the primary arm plate 4 or 5, to enable the user to hang an upper body garment, such as a sport jersey, or any other type of shirt. As showing in FIG. 3(*a*), FIG. 3(*b*) and FIG. 3(*c*), in some embodiments, the garment display device 10 also includes at least one left secondary arm plate 20 and at least one right secondary arm plate 21. Preferably, the right and left secondary arm plates 20 and 21 have the same design as the left and right primary arm plates 4 and 5, as described above. The first pair of left and right secondary arm plates 20 and 21 are each rotatably attached to their respective left and right primary arm plate 4 or 5. The secondary arm plates 20 and 21 rotate within a single plane.

In some embodiments, their rotation range within that plane is at least 180 degrees. In some embodiments, their rotation range is at least 90 degrees. The plane of rotation of the primary arm plates 4 and 5 is the same or parallel to the plane of rotation of the secondary arm plates 20 and 21. The primary arm plates 4 and 5 may be attached to the secondary arm plates 20 and 21 in any manner that allows each arm plate 4, 5, 20 or 21 to rotate in the plane, while also being detachable from the neighboring arm plate 4, 5, 20 or 21. One or more additional pairs of secondary left and right arm plates 20 and 21 may be attached to the first pair of secondary arm plates 20 and 21.

In some embodiments, they are attached in the same manner that the first pair of secondary arm plates 20 and 21 was attached to the primary arm plates 4 and 5. In some embodiments, a plurality of left and right secondary arm plates 20 and 21 may be connected to the garment display device 10. The primary arm plates 4 and 5 are attached to the secondary arm plates 20 and 21 such that the plate support member 6 of one arm plate 4, 5, 20 or 21 is attached to the extender member 7 of another arm plate 4, 5, 20 or 21. Thus, in some embodiments, as shown in FIG. 3(*a*), FIG. 3(*b*), and FIG. 3(*c*), the plate support member 6 on the primary arm plate 4 or 5 is attached to the plate extender member 7 of the neighboring secondary arm plate 20 or 21. In other embodiments, the primary plate 4 or 5 extender member 7 is attached to the plate support member 6 of the neighboring secondary arm plate 20 or 21.

Likewise, in those embodiments including more than one pair of secondary arm plates 20 and 21, each pair of secondary arm plates 20 and 21 is attached to the neighboring pair of secondary arm plates 20 and 21 such that the plate support member 6 of one secondary arm plate is attached to the extender member 7 of another secondary arm plate 20 or 21.

The garment display device 10 may be attached to a surface, such as for example a wall, where it is available for hanging of a garment. The garment display device 10 may be configured to be attached to the surface in any suitable manner, such as for example by nailing or screwing. In some embodiments, for example, as shown in FIG. 1, FIG. 3(*a*), FIG. 3(*b*) and FIG. 3(*c*), the support arms 2 and 3 of the garment display device 10 are may be configured to be attached to a shelving unit 22. In some embodiment, the support arms 2 and 3 may be attached at any suitable position on the shelving unit 22. As noted above, the shape of the support arms 2 and 3 may vary, depending on the desired design of the garment display device 10. As shown in FIG. 1, FIG. 2, FIG. 3(*a*), and FIG. 3(*b*) in some embodiments, the support arms 2 and 3 are substantially Z-shaped. This Z-shaped design enables the support arms 2 and 3 to be attached to a surface, such as the back of a shelving unit 22, while providing enough forward space for a garment (not shown) hanging from the garment display device 10, to hang neatly, without being impeded by any surfaces behind the garment (not shown).

Figure 4:
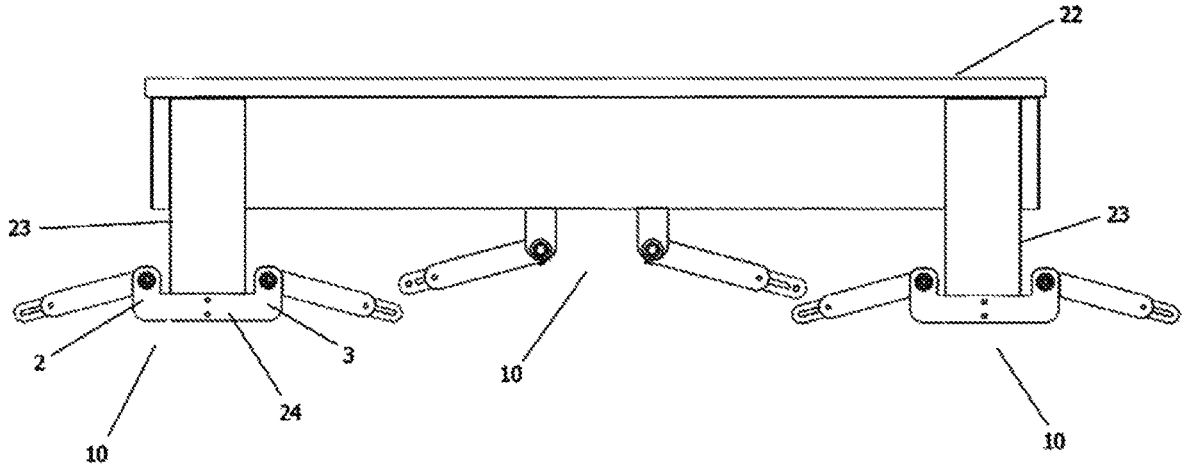
FIG. 4 is a front view of multiple garment display devices attached to a shelving unit.

In some embodiments, multiple garment display devices 10 can be used on the same hanging unit. For example, in some embodiments, as shown in FIG. 4, more than one garment display device 10 is attached to a shelving unit 22. The garment display devices 10 are hung far enough from each other that a garment (not shown) hanging from each device 10 can be clearly displayed. The garment display devices 10 may be hung at the same vertical level, or, they may be hung at the different vertical levels. In some embodiments, a lengthening panel 23 may be used to achieve these height variations of the garment display devices 10. For example, as shown in FIG. 4, in some embodiments, a lengthening panel 23 is attached to a shelving unit 22. The lengthening panel 23 is attached on one end to the shelving unit 22, and the garment hanging device 10 is attached at the desired height on the lengthening panel 23.

Figure 5:
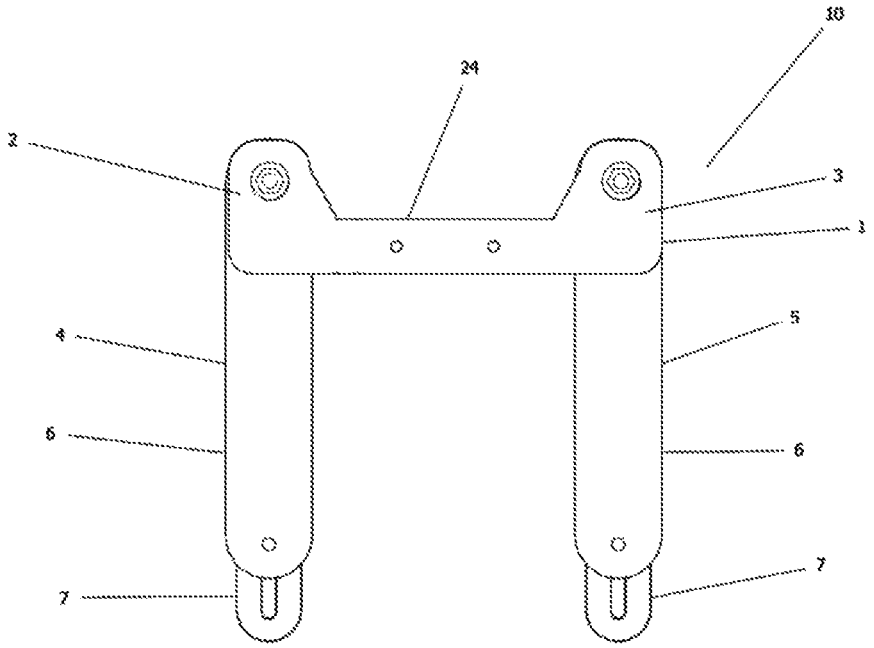
FIG. 5. is a front view of a garment display device with an anchor plate attached to the support arms.
Figure 6:
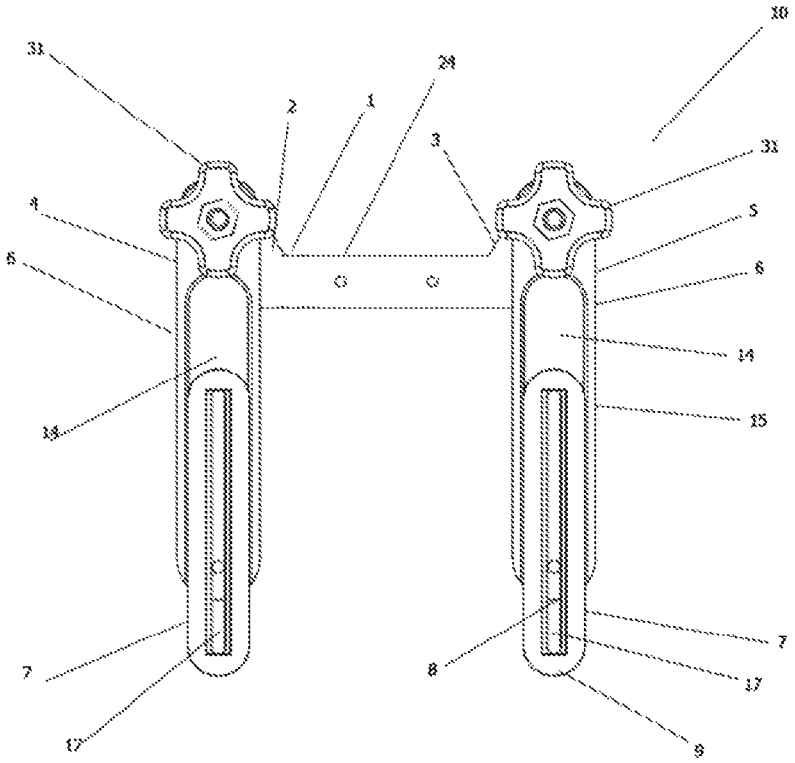
FIG. 6 is a rear view of a garment display device with an anchor plate attached to the support arms.
Figure 7:
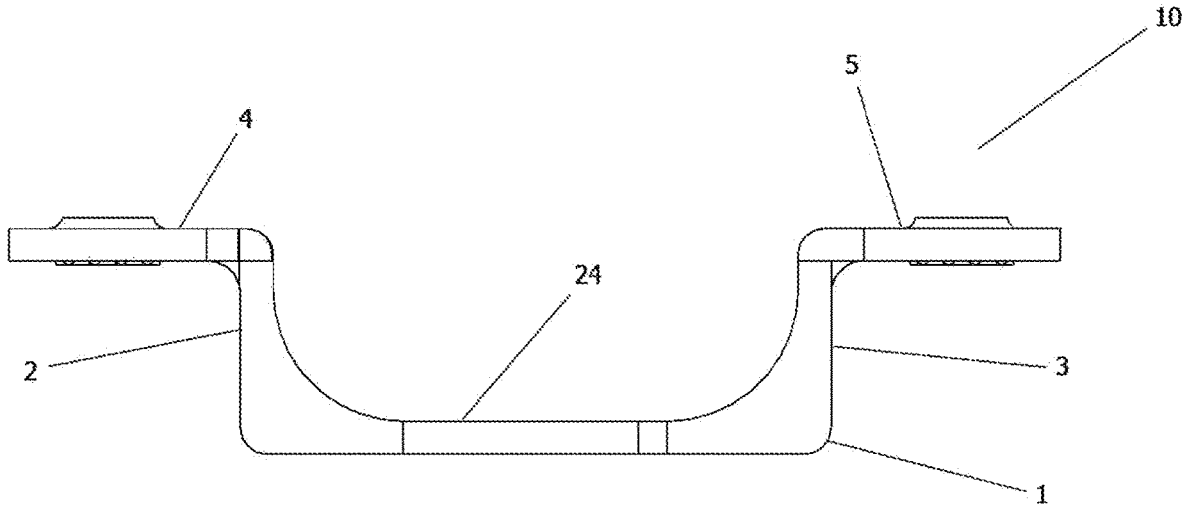
FIG. 7 is a top view of the garment display device with an anchor plate attached to the support arms.

As shown in FIG. 1, FIG. 3(*a*) and FIG. 3(*b*), in some embodiments, the attachment base 1 may include two independent left and right support arms 2 and 3. As shown in FIG. 4 to FIG. 8, in some embodiments, the left and right support arms 2 and 3 are be connected to one another by an anchor panel 24. The anchor panel 24 may be an independent unit attached to the left and right support arms 2 and 3, or the support arms 2 and 3 and the anchor panel 24 may form a single, uninterrupted unit. The anchor panel 24 may have any suitable shape. As shown in FIG. 7, in some embodiments, the anchor panel 24 is a flat panel, forming a substantially U-shaped attachment base 1, along with the support arms 2 and 3. As shown in FIG. 6, in some embodiments of the invention, the extender member 7 has a cutout 17 extending along at least a portion of the length of the extender member 7. In some embodiments, the cutout 17 extends down at least 80 percent of the length of the extender member 7. In some embodiments, a securing device (not shown), such as a screw extends through the plate support member 6, and cutout 17 in the extender member 7, thereby connecting the plate support member 6 and the extender member 7. A device such as a nut (not shown) can be used to hold the securing device (not shown) in place.

The garment display device components may be made of any suitable material, such as for example metal or a polymeric material. There may be various ways of making and assembling the components of the present device. In some embodiments, the device components may be made by any suitable method, such as for example, molding or 3-D printing. The device components may be attached to one another by any suitable method, such as, for example by nails, screws, or nuts, and may be secured, for example with bolts.

Figure 8:
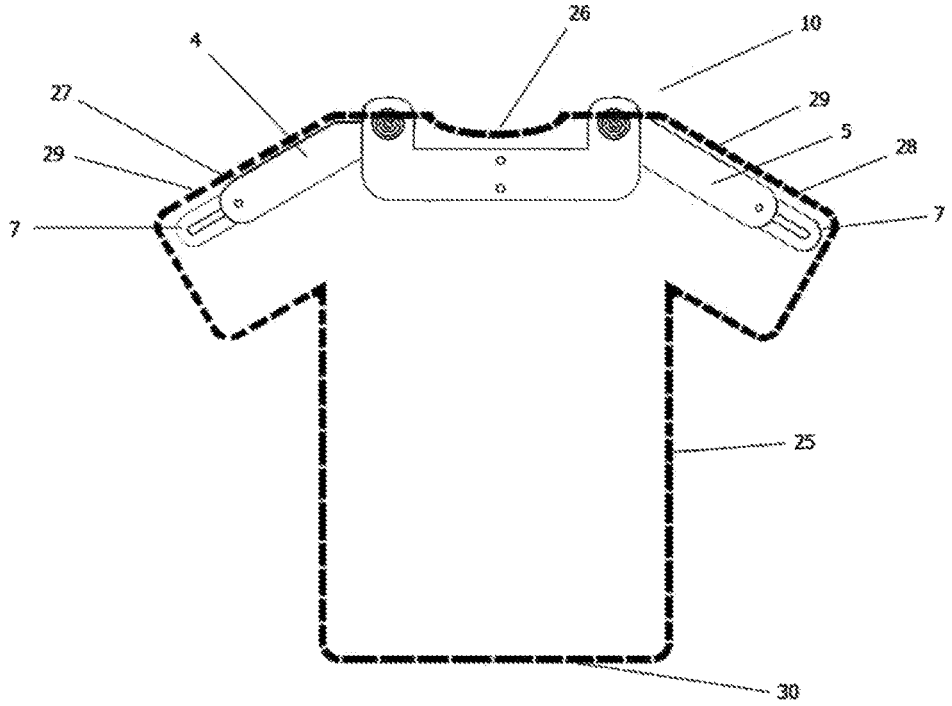
FIG. 8 is a front view of a garment display device with a garment hanging on the device.

This invention also includes methods of using the garment display device 10 to hang upper body garments, and display them in an aesthetically pleasing way. In some embodiments, to use the garment display device 10, the orientation of the left and right primary arm plates 4 and 5 may be configured by a user in a substantially vertical downward position, as shown in FIG. 5 and FIG. 6. If the garment display device 10 also includes one or more pairs of secondary arm plates 20 and 21, these secondary arm plates 20 and 21 are also oriented in a substantially vertical downward position. This downward orientation enables the user to easily insert the neck 26 of the upper body garment 25 (shown in FIG. 8) around the primary arm plates 4 and 5 and, if present, secondary arm plates 20 and 21, in an upward motion. As shown in FIG. 8, the user raises the left primary arm plate 4 and left secondary arm plate 20 (if present), upwards toward the left shoulder portion 27 (shown in FIG. 8) of the garment 25; and raises the right primary arm plate 5 and right secondary arm plate 21 (if present), upwards toward the right shoulder portion 28 of the garment 25. The user shortens or lengthens the length of the primary arm plates 4 and 5, and if present, the length of the secondary arm plates, by adjusting the extender panels 7, to provide support for the arms 29 of the garment 25, which can vary, depending on the type of garment 25.

The abovementioned raising of the garment 25, and of the primary arm plates 4 and 5, and secondary arm plates 20 and 21 (if present), can be most easily achieved by the user inserting their arms into the garment 25 from the bottom 30 of the garment 25. As shown in FIG. 8, these steps result in a garment 25 hanging on the garment display device 10 in a manner that provides support for the garment arms 29, enabling a well-supported and aesthetically pleasing display of the garment 25.

In those embodiments where the garment display device is configured to be attached to a shelving unit, the user can display items on the shelving unit, such as for example collectables, photos, trophies, hats, and books. This is especially desirable for users, as they can display their garment, such as for example a team jersey, alongside other items, such as for example, team paraphernalia.

Many modifications and other examples of the disclosure set forth herein will come to mind to those skilled in the art to which this disclosure pertains, having the benefit of the teachings presented in the foregoing descriptions and the associated drawings. Therefore, it is to be understood that the disclosure is not to be limited to the specific examples disclosed and that modifications and other embodiments are intended to be included within the scope of the appended claims.

Moreover, although the foregoing descriptions and the associated embodiments describe aspects of the disclosure in the context of certain example combinations of structural elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A garment display device comprising:

an attachment base comprising a pair of support arms comprising a left support arm, and a right support arm;

a right primary arm plate rotatably attached to the right support arm;

a left primary arm plate rotatably attached to the left support arm, wherein:

the right and left primary arm plates are rotatable within a single plane;

the right and left primary arm plates each comprise:

a plate support member comprising an upper surface, a lower surface, side surfaces, and a recess within one of the upper surface or the lower surface; and an extender member extendably connected to one of the upper surface or the lower surface of the support member, the extender member is slidable within the recess, and each primary arm plate is connectable to a secondary arm plate;

at least one secondary right arm plate; and at least one secondary left arm plate, wherein:

at least one of the secondary right arm plates is rotatably and detachably attached to the primary right arm plate, at least one of the secondary left arm plates is rotatably and detachably attached to the primary left arm plate, and the at least one secondary right and left arm plates each comprise a secondary plate support member, respectively, comprising an upper surface, a lower surface and side surfaces, and a secondary plate extender member extendably connected to one of the upper surface or the lower surface of the secondary plate support member.

2. The garment display device according to claim 1, wherein the left and right support arms are each substantially Z-shaped.

3. The garment display device according to claim 1, wherein the attachment base further comprises an anchor panel.

4. The garment display device according to claim 3, wherein the left support arm, right support arm, and anchor panel form a single, uninterrupted unit.

5. The garment display device according to claim 1, wherein the attachment base is attached to a shelving unit.

6. The garment display device according to claim 5, wherein more than one attachment bases are attached to the shelving unit.

7. The garment display device according to claim 6, wherein at least one of the attachment bases is attached to a lengthening panel that is attached to the shelving unit.

8. The garment display device according to claim 1, wherein the extender member is extendable by sliding the extender member.

9. The garment display device according to claim 1, wherein each extender member comprises a top surface, a bottom surface, and at least two cutouts extending from the top to the bottom surface of the extender member, and the plate support member further comprises at least one protrusion extending from the upper surface or the lower surface of the plate support member.

10. The garment display device according to claim 9, wherein a plurality of cutouts extend from the top to the bottom surface of each extender member.

11. The garment display device according to claim 1, wherein the garment display device comprises at least one additional secondary right arm plate, and at least one additional secondary left arm plate, wherein each additional secondary right arm plate is rotatably and detachably attached to at least one other secondary right arm plate, and each additional secondary left arm plate is rotatably and detachably attached to at least one other secondary left arm plate.

12. The garment display device according to claim 11, wherein the device further comprises:

a plurality of secondary right arm plates rotatably and detachably attached to one another; and a plurality of secondary left arm plates rotatably and detachably attached to one another.

13. The garment display device according to claim 1, wherein:

at least one of the primary plate support members is attached to the plate extender member of a secondary arm plate; or at least one of the primary plate extender members is attached to the plate support member of a secondary arm plate.

14. The garment display device according to claim 1, wherein each secondary plate support member is attached to the plate extender member of a different secondary arm plate.

15. A method of hanging a garment on the garment display device according to claim 1, comprising the steps of:

orienting the left and right primary arm plates in a substantially vertical, downward position;

orienting the left and right secondary arm plates in a vertical, downward position;

inserting the pairs of primary and secondary arm plates into a neck of a garment;

raising the left primary arm plate and the secondary arm plate upwards, toward a left shoulder portion of the garment; and raising the right primary arm plate and the right secondary arm plate upwards, toward a right shoulder portion of the garment.

16. The method according to claim 15, further comprising the step of adjusting the extender members of at least one of the pairs of primary or secondary arm plates, thereby lengthening or shortening the arm plates.

17. A method of hanging a garment on the garment display device according to claim 1, comprising the steps of:

orienting the left and right primary arm plates in a substantially vertical, downward position;

inserting the pair of primary arm plates into a neck of a garment;

raising the left primary arm plate upwards, toward a left shoulder portion of the garment;

raising the right primary arm plate upwards, toward a right shoulder portion of the garment; and adjusting the extender members of at least one of the pairs of primary or secondary arm plates by sliding the extender members within the recesses, thereby lengthening or shortening the arm plates.

* * * * *